US011013947B2

(12) United States Patent
Svenberg

(10) Patent No.: US 11,013,947 B2
(45) Date of Patent: May 25, 2021

(54) WEIGHT APPARATUS INCLUDING WEIGHT ADJUSTMENT ARRANGEMENT

(71) Applicant: Personality Gym AB, Huskvarna (SE)

(72) Inventor: Tomas Svenberg, Huskvarna (SE)

(73) Assignee: Personality Gym AB, Huskvarna (SE)

( * ) Notice: Subject to any disclaimer, the term of this patent is extended or adjusted under 35 U.S.C. 154(b) by 0 days.

(21) Appl. No.: 16/265,735

(22) Filed: Feb. 1, 2019

(65) Prior Publication Data

US 2019/0168058 A1 Jun. 6, 2019

Related U.S. Application Data

(63) Continuation of application No. 15/361,400, filed on Nov. 26, 2016, now Pat. No. 10,232,214, which is a continuation of application No. 15/251,288, filed on Aug. 30, 2016, now Pat. No. 9,566,465, which is a continuation of application No. 14/563,814, filed on Dec. 8, 2014, now Pat. No. 9,452,312, which is a continuation of application No. 13/412,457, filed on Mar. 5, 2012, now Pat. No. 8,932,188.

(51) Int. Cl.

| | |
|---|---|
| ***A63B 21/075*** | (2006.01) |
| ***A63B 21/072*** | (2006.01) |
| *A63B 21/00* | (2006.01) |

(52) U.S. Cl.

CPC ..... *A63B 21/075* (2013.01); *A63B 21/072* (2013.01); *A63B 21/0724* (2013.01); *A63B 21/0726* (2013.01); *A63B 21/0728* (2013.01); *A63B 21/00058* (2013.01); *A63B 21/00065* (2013.01); *A63B 2209/08* (2013.01)

(58) Field of Classification Search

CPC ..... A63B 21/00058; A63B 21/00061; A63B 21/00065; A63B 21/00069; A63B 21/00072; A63B 21/063; A63B 21/072; A63B 21/0724; A63B 21/0726; A63B 21/075; A63B 21/0728; A63B 21/08; A63B 21/4033; A63B 21/4034

USPC .... 482/44, 49–50, 92–94, 97–108, 148, 908

See application file for complete search history.

(56) References Cited

U.S. PATENT DOCUMENTS

| | | | | |
|---|---|---|---|---|
| 4,529,197 A * | 7/1985 | Gogarty | ..... | A63B 21/0728 482/107 |
| 4,638,994 A * | 1/1987 | Gogarty | ..... | A63B 21/0728 482/107 |
| 4,955,603 A * | 9/1990 | Becker | ..... | A63B 21/0728 482/107 |

(Continued)

*Primary Examiner* — Joshua Lee

(74) *Attorney, Agent, or Firm* — WRB-IP LLP

(57) ABSTRACT

A weight apparatus includes a bar including a handle rotatably attached to an anchorage. The anchorage includes a body and at least one radially extendable and retractable pin, the pin being movable relative to the body between an innermost position and an outermost position. An end of the pin extends radially beyond an external surface of the body when the pin is in the outermost position. The apparatus further includes a weight including a weight opening in which the anchorage is adapted to be received. The weight includes a radially extending pin opening adapted to receive the pin when the pin is in the outermost position to attach the weight to the anchorage. An arrangement is provided for driving the pin to the outermost position upon rotation of the handle relative to the anchorage.

12 Claims, 6 Drawing Sheets

(56) References Cited

U.S. PATENT DOCUMENTS 5,078,392 A * 1/1992 Kracht ..... A63B 21/0728 482/107
5,284,463 A * 2/1994 Shields ..... A63B 21/0728 482/107
5,344,375 A * 9/1994 Cooper ..... A63B 21/0728 482/106
5,839,997 A * 11/1998 Roth ..... A63B 21/0728 482/107
6,416,446 B1 * 7/2002 Krull ..... A63B 21/075 482/107
6,540,650 B1 * 4/2003 Krull ..... A63B 21/0728 482/107
7,087,000 B1 * 8/2006 Walker ..... A63B 21/0728 482/106
7,090,625 B2 * 8/2006 Chermack ..... A63B 21/075 482/107
7,128,696 B1 * 10/2006 Krull ..... A63B 21/0728 482/107
7,172,536 B2 * 2/2007 Liu ..... A63B 21/0728 482/108
7,485,077 B2 * 2/2009 Chen ..... A63B 21/0728 482/106
7,491,155 B2 * 2/2009 Fenelon ..... A63B 21/0601 482/107
7,578,772 B2 * 8/2009 Lippitt ..... A63B 21/0728 482/106
7,621,855 B1 * 11/2009 Krull ..... A63B 21/075 482/107
D639,358 S * 6/2011 Rauwerdink ..... D21/681
8,007,415 B1 * 8/2011 Lundquist ..... A63B 21/075 482/107
8,025,613 B1 * 9/2011 Wang ..... A63B 21/0726 482/107
8,075,458 B2 * 12/2011 Nalley ..... A63B 21/0615 482/94
8,298,125 B2 * 10/2012 Colledge ..... A63B 21/075 482/107
8,529,415 B2 * 9/2013 Svenberg ..... A63B 21/0728 482/108
9,504,868 B2 * 11/2016 Liu ..... A63B 21/0726
2003/0148862 A1 * 8/2003 Chen ..... A63B 21/063 482/108
2004/0005969 A1 * 1/2004 Chen ..... A63B 21/063 482/107
2005/0277525 A1 * 12/2005 Liu ..... A63B 21/075 482/107
2006/0189458 A1 * 8/2006 Walkerdine ..... A63B 71/0036 482/106
2007/0161474 A1 * 7/2007 Lippitt ..... A63B 21/075 482/106
2007/0184945 A1 * 8/2007 Lin ..... A63B 21/075 482/107
2007/0225132 A1 * 9/2007 Liu ..... A63B 21/0783 482/106
2008/0026921 A1 * 1/2008 Liu ..... A63B 21/063 482/107
2008/0188362 A1 * 8/2008 Chen ..... A63B 21/075 482/107
2009/0042700 A1 * 2/2009 Liu ..... A63B 21/075 482/107
2009/0048079 A1 * 2/2009 Nalley ..... A63B 21/063 482/107
2009/0186748 A1 * 7/2009 Golesh ..... A63B 21/075 482/107
2009/0305852 A1 * 12/2009 Hoglund ..... A63B 21/0728 482/107
2010/0304940 A1 * 12/2010 Svenberg ..... A63B 21/075 482/108
2010/0323856 A1 * 12/2010 Svenberg ..... A63B 21/075 482/108
2011/0245048 A1 * 10/2011 Nalley ..... A63B 21/0728 482/107
2012/0021877 A1 * 1/2012 Lundquist ..... A63B 21/075 482/107
2012/0115689 A1 * 5/2012 Dalebout ..... A63B 21/0728 482/107
2012/0309597 A1 * 12/2012 Liu ..... A63B 21/0726 482/107

* cited by examiner

WEIGHT APPARATUS INCLUDING WEIGHT ADJUSTMENT ARRANGEMENT

The present application is a continuation of U.S. application Ser. No. 15/361,400, filed Nov. 26, 2016, which is a continuation of U.S. application Ser. No. 15/251,288, filed Aug. 30, 2016, (now U.S. Pat. No. 9,566,465, issued Feb. 14, 2017) which is a continuation of U.S. application Ser. No. 14/563,814, filed Dec. 8, 2014, (now U.S. Pat. No. 9,452,312, issued Sep. 27, 2016) which is a continuation of U.S. application Ser. No. 13/412,457, filed Mar. 5, 2012 (now U.S. Pat. No. 8,932,188, issued Jan. 13, 2015).

BACKGROUND AND SUMMARY

The present invention relates generally to weight apparatus and, more specifically, to weight apparatus having arrangements for adjusting the amount of weight on a bar.

U.S. patent application Ser. Nos. 12/744,965, 12/744,972, and 12/744,975, which are incorporated by reference, disclose weight apparatus comprising a bar to which a different number of weight discs can be attached by rotating a handle of the bar relative to an anchorage of the bar while the bar rests in a specially adapted stand. FIG. 5 shows a bar 23 of a weight apparatus comprising features of the present invention in combination with a weight apparatus of the general type disclosed in U.S. patent application Ser. Nos. 12/744,965, 12/744,972, and 12/744,975, although it will be appreciated that the present invention is not limited for use in connection with a weight apparatus as disclosed in those applications. The weight apparatus illustrated in those applications and the bar 23 in FIG. 5 is a dumbbell, however, it will be appreciated that the structures described can be adapted for use in a barbell by, for example, providing a longer handle.

Features of the bar 23 shown in FIG. 5 common to those applications include the bar having a handle 25 rotatably attached to an anchorage 27. The handle 23 has an inner tube 101 with two longitudinal apertures 103. Solid rods 51 are longitudinally displaceable interiorly in the inner tube 101 and have pins 105 which extend radially out through the apertures 103 so that the rods 51 are prevented from rotating relative to the inner tube 101. Outside the inner tube 101, there is provided an outer tube 107 with two helical grooves 109 in which the pins 105 are accommodated. When relative rotation takes place between the inner tube 101 and the outer tube 107, the rods 5 will move axially in the longitudinal direction.

A rotary handle portion 111 is non-rotatably attached to an outer side the outer tube 107. The handle portion 111 is rotationally interconnected with an index ring 113 that forms part of an indexing device and which displays, along its periphery, markings 115 for the number of weight disks 71 and 73 to be accommodated on the handle 23. The markings 115 can be viewed through an opening 117 in a body 31 of the anchorage 27. The body 31 of the anchorage 27 is rotationally fixed to the inner tube 101.

The body 31 of the anchorage 27 is non-rotatable relative to the stand 65 (FIG. 1B) when the handle 23 rests in the bar seat 69 (FIG. 1B) of the stand by means of a projection (not shown) on the bar seat that extends through an opening (not shown) in the external surface 39 of the body of the anchorage to urge a sliding portion 119 having an opening 121 through which the rods 51 extend against the force of springs 123 to disengage edges 125 of the sliding portion from respective notches 127 in the rods. When the handle 23 rests in the bar seat 69 in a proper position to disengage the edges 125 of the sliding portions 119 from the notches 127 in the rods 51, the rods 51 can be axially moved relative to the inner tube 101 by twisting the handle portion 111 and, in this way, it is possible for a user to select a desired number of weight disks 71 and 77 (e.g., FIG. 1B) to be carried on the handle 23.

Ordinarily, the weight discs 71 and 77 are of the same weight or mass. On a dumbbell, for example, each disc 71 and 77 may be 2 kg so that weight can be added or subtracted only in increments of 4 kg (2 kg on each end of the dumbbell). It is often desirable, however, to permit adjustment of weight in smaller increments.

According to an aspect of the present invention, a weight apparatus comprises a bar comprising a handle attached to an anchorage, the handle and the anchorage having an axially extending opening, the anchorage comprising a body and at least one radially extending pin, the radially extending pin being movable relative to the body between an innermost position in which a first end of the pin extends into the opening and an outermost position in which a second end of the pin extends radially beyond an external surface of the body. The weight apparatus further comprises a rod disposed in the opening, at least a first portion of the rod having a first width and a second portion of the rod having a second, smaller width, the rod being arranged to axially move in the opening between a first position in which the first portion of the rod is adapted to contact the first end of the pin so that the pin is not movable inwardly of the outermost position and a second position in which the second portion of the rod is adapted to contact first end of the pin so that the pin is movable to the innermost position, and a weight comprising a weight opening in which the anchorage is adapted to be received, the weight comprising a radially extending pin opening adapted to receive the pin when the pin is in the outermost position to attach the weight to the anchorage.

According to another aspect of the present invention, a weight apparatus comprises a bar comprising a handle attached to an anchorage, the anchorage comprising a body and at least one radially extendable and retractable pin, the pin being movable relative to the body between an innermost position and an outermost position, an end of the pin extending radially beyond an external surface of the body when the pin is in the outermost position, a weight comprising a weight opening in which the anchorage is adapted to be received, the weight comprising a radially extending pin opening adapted to receive the pin when the pin is in the outermost position to attach the weight to the anchorage, and means for driving the pin to the outermost position.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
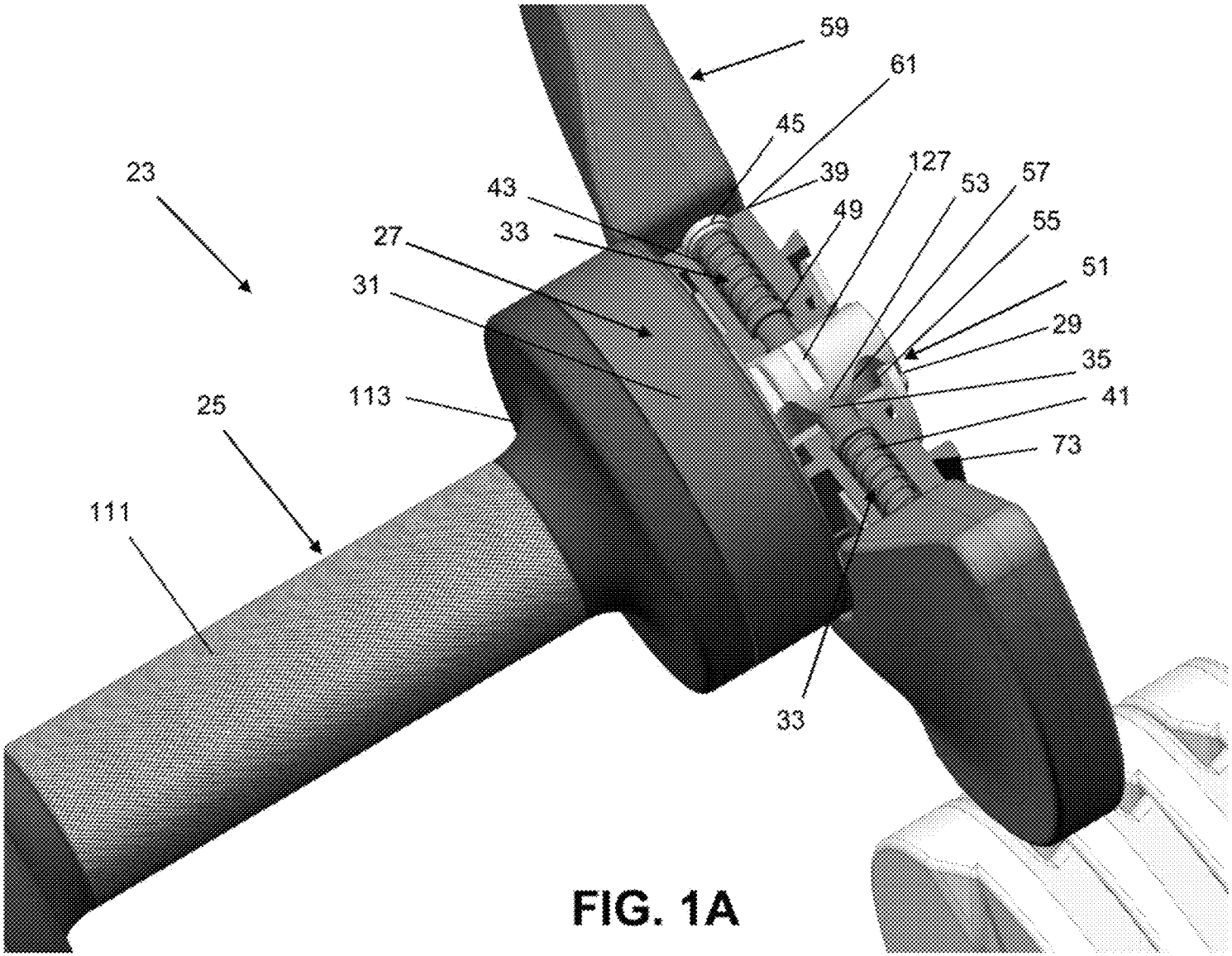
FIG. 1A is a perspective, partially cross-sectional view of a portion of a weight apparatus according to an aspect of the present invention.
Figure 1B:
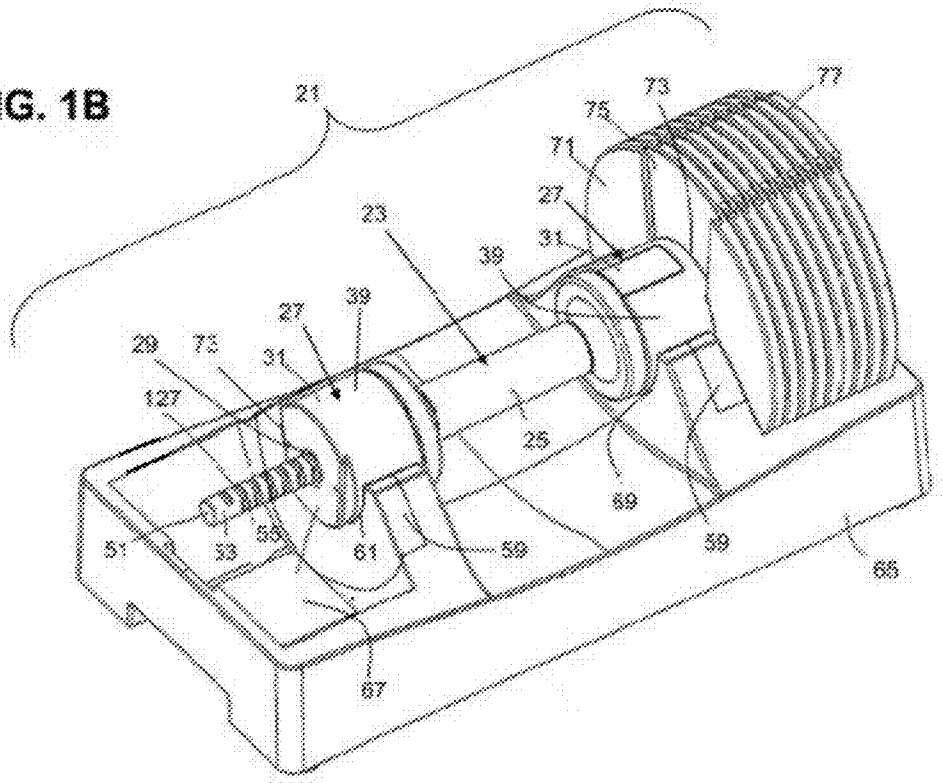
FIG. 1B is another perspective view of the weight apparatus of FIG. 1A.

A weight apparatus 21 according to an aspect of the present invention is shown in FIG. 1A-1B. The weight apparatus 21 comprises a bar 23 seen in FIGS. 2-4 comprising a handle 25 rotatably attached to an anchorage 27. The handle 25 and the anchorage 27 have an axially extending opening 29.

The anchorage 27 comprises a body 31 and at least one radially extending pin 33. The radially extending pin 33 is movable relative to the body 31 between an innermost position (seen in FIGS. 2 and 3) in which a first end 35 of the pin extends into the opening 29 and an outermost position (seen in FIG. 4) in which a second end 37 of the pin extends radially beyond an external surface 39 of the body. Ordinarily, the pin 33 is spring loaded via a resilient member such as a spring 41 that urges the pin to the innermost position. The pin 33 and spring 41 can be retained in a hole 43 in the anchorage body 31 by an insert 45 having a hole 47 (FIG. 3) through which the second end 37 of the pin can extend but which prevents the spring from coming out of the hole. The spring 41 can be compressed between the insert 45 and a flange 49 on the pin 33. The flange 49 ordinarily is unable to extend through the hole 47 in the insert 45. Ordinarily, in each anchorage 27 at least two pins 33 extend in radially different directions, usually radially opposite directions.

Ordinarily, means such as a cam is provided to drive the pin 33 to the outermost position upon rotation of the handle 25 relative to the anchorage 27, although various alternative arrangements for moving the pin 33 between the outermost and the innermost positions can be provided, such as solenoids, magnets, toothed drives driven by knobs on the anchorage, and the like, and need not involve rotation of the handle. The cam can form part of a rod 51 disposed in the opening 29. As seen, for example, in FIGS. 2-4, at least a first portion 53 of the rod 51 can have a first width and a second portion 55 of the rod can have a second, smaller width. The rod 51 can comprise a continuous, curved surface 57 extending between the wide first portion 53 and the narrower second portion 55 to facilitate sliding of the first end 35 of the pin 33 between the first and second portions.

Figure 2:
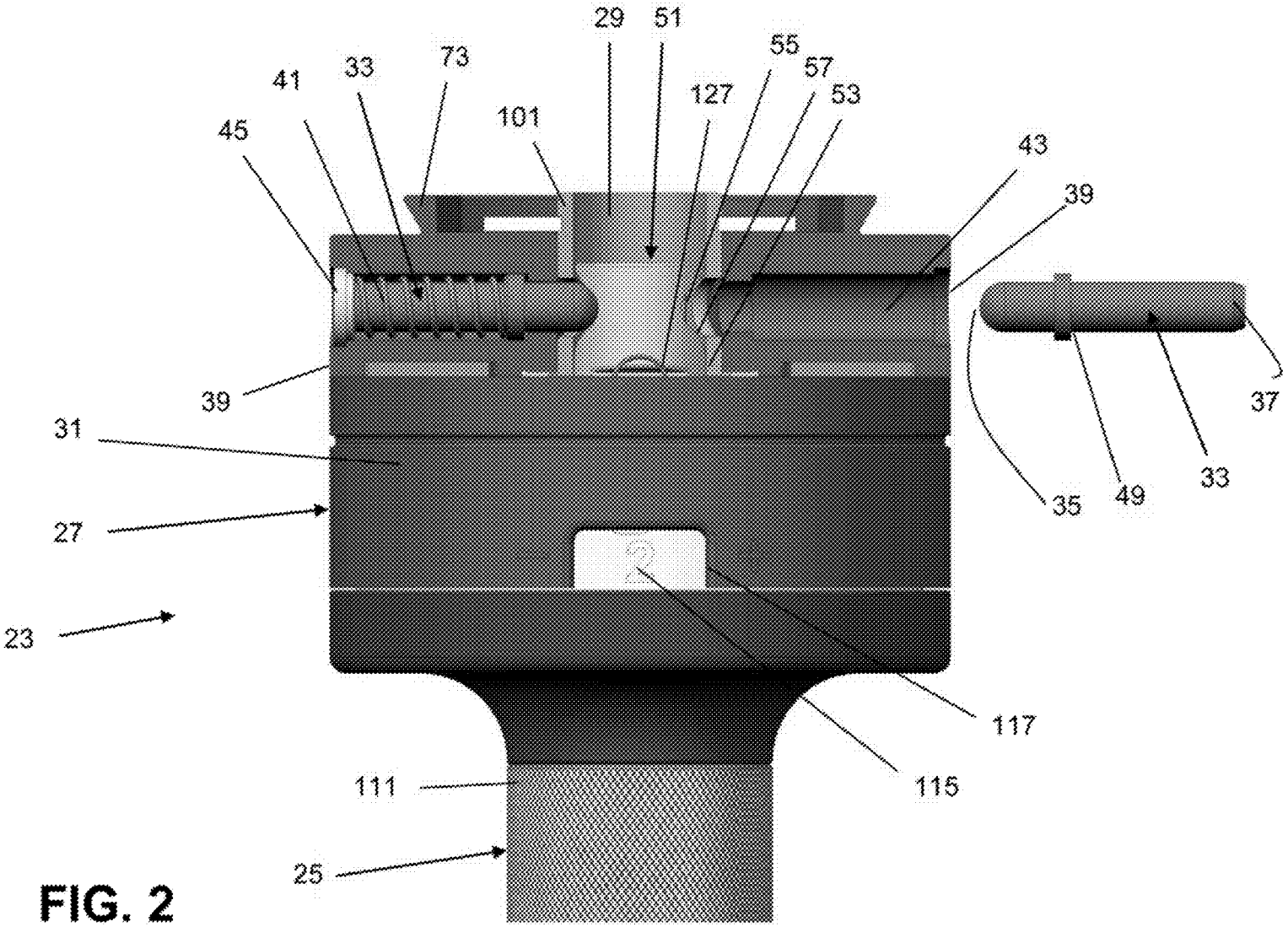
FIGS. 2 and 3 are a side, partially cross-sectional, partially exploded view and a perspective, partially cross-sectional, partially exploded view, respectively, of the weight apparatus showing a radially extending pin in an innermost position.
Figure 3:
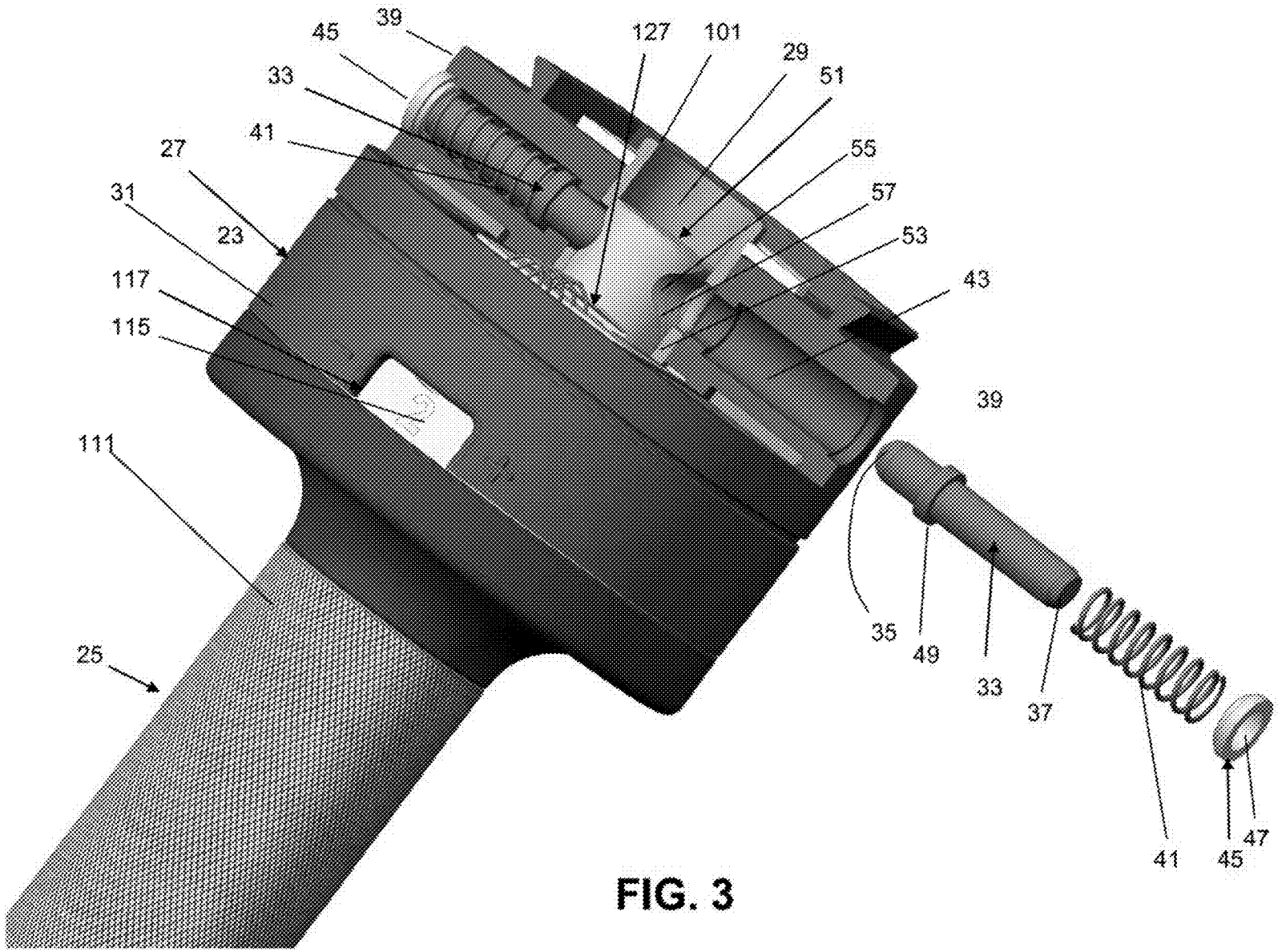
Figure 4:
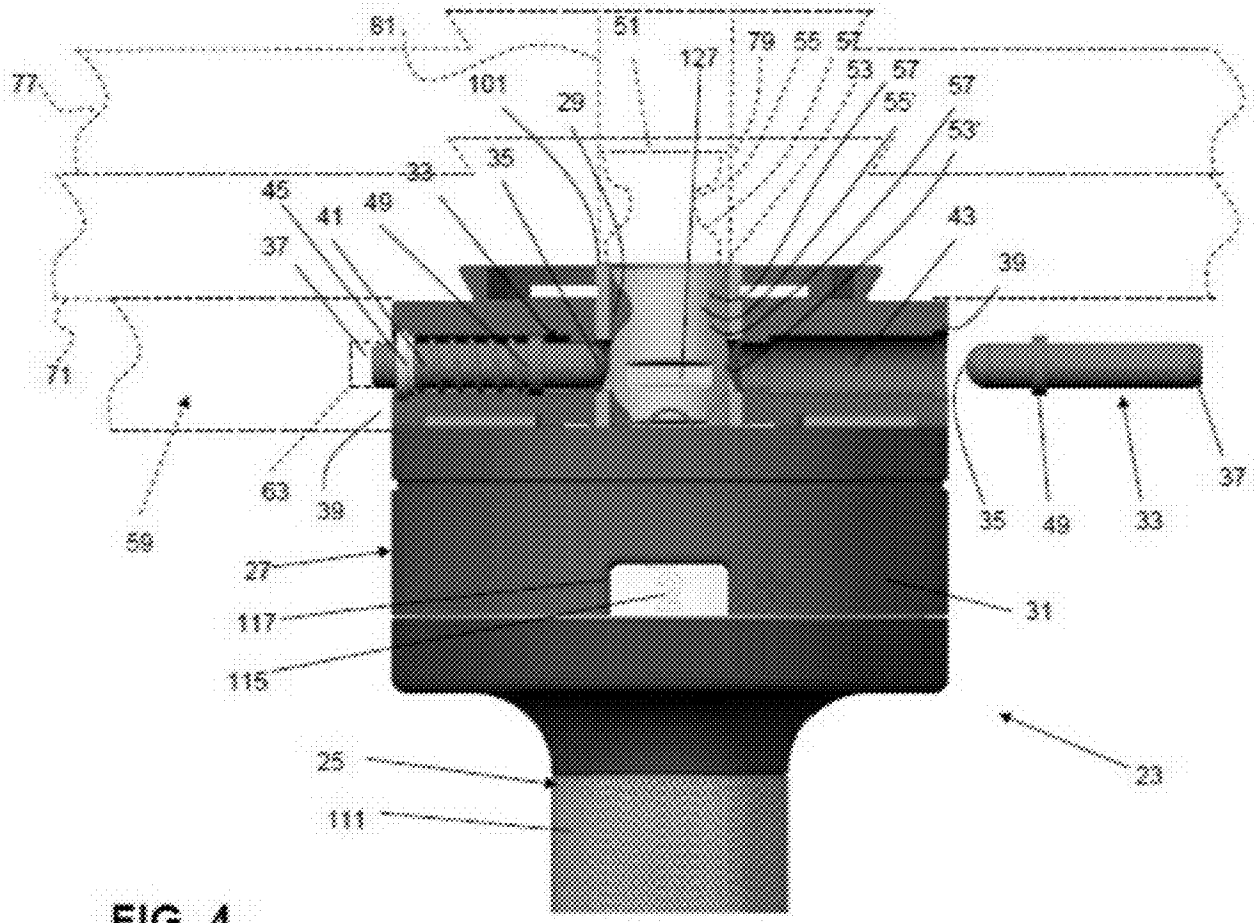
FIG. 4 is a side, partially cross-sectional, partially exploded view of the weight apparatus showing a radially extending pin in an outermost position.

The rod 51 can be arranged to axially move in the opening 29 upon rotation of the handle 25 relative to the anchorage 27 between a first position seen, for example, in FIGS. 1A and 4, in which the first portion 53 of the rod is adapted to contact the first end 35 of the pin 33 so that the pin is not movable inwardly of the outermost position and a second position seen, for example, in FIGS. 2 and 3, in which the second portion 55 of the rod is adapted to contact first end of the pin so that the pin is movable to the innermost position. As the rod 51 moves between the first and second positions, the spring 41 can urge the first end 35 of the pin 33 against first portion 53, the curved surface 57, and the second portion 55 of the rod so that as the pin moves from the outermost position to the innermost position, the second end 37 of the pin moves from a position in which it is disposed radially beyond the external surface 39 of the body 31 to a position in which it is disposed further radially inwardly, ordinarily even with or radially inwardly of the external surface of the body. As seen in FIG. 4, the rod 51 typically comprises, along its length, a plurality of portions 53 (shown in phantom), 53', etc. having the first width and a portion 55, 55', etc. having the second width disposed between each two portions having the first width and closest to an end of the rod. The rod 51 is arranged to axially move in the opening 29 upon rotation of the handle 25 relative to the anchorage 27 to a plurality of positions, and, in each position of the plurality of positions, either one of the plurality of portions 53, 53', etc., having the first width or the portion 55, 55' having the second width is adapted to contact the first end 35 of the pin 33. It will be appreciated that it is possible to move the rod 51 axially in the opening 29 by arrangements other than by rotating the handle 25 relative to the anchorage 27.

Figure 5:
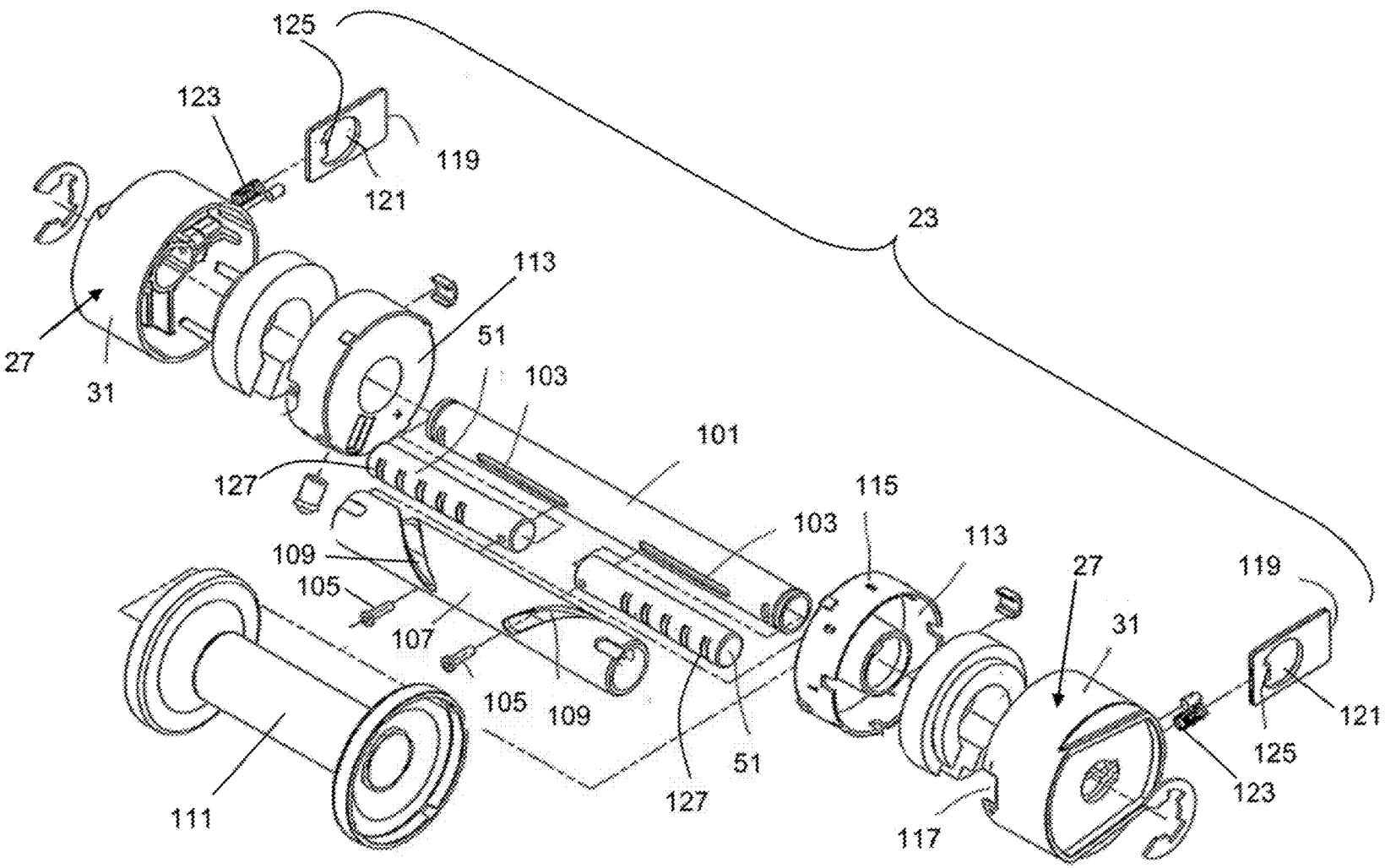
FIG. 5 is a perspective, exploded view of the weight apparatus.

FIG. 5 is an exploded view of a type of a bar 23 of a weight apparatus suitable for use in connection with the present invention. Details of the bar are disclosed in U.S. patent application Ser. Nos. 12/744,965, 12/744,972, and 12/744,975 which disclose weight apparatus comprising rods disposed in and arranged to be axially movable in openings in bars upon rotation of a handle relative to an anchorage of a type suitable for use in connection with the present invention and are incorporated by reference. In the weight apparatus disclosed in these applications, the rod is non-rotatable relative to the anchorage, although this is not a necessary characteristic of the weight apparatus.

A weight 59 (a portion of which is shown in phantom in FIG. 4) comprising a weight opening 61 (FIGS. 1A and 1B) in which the anchorage 27 is adapted to be received is provided and comprises one or more radially extending pin openings 63 (one shown in phantom in FIG. 4, showing part of the weight), each pin opening being adapted to receive the second end 37 of a respective pin 33 extending from the anchorage when the pin is in the outermost position to attach the weight to the anchorage. Where the anchorage 27 comprises two or more radially extending pins 33, the weight 59 comprises two or more corresponding pin openings 63 for receiving respective ones of the pins. As seen in FIGS. 1A and 1B, the weight 59 can be generally U-shaped so that the anchorage 27 is adapted to be received radially in and removed radially from the weight opening 61 when the pin 33 is in the innermost position.

As seen in FIG. 1B, the weight apparatus 21 ordinarily comprises two anchorages 27 rotatably attached to opposite ends of the handle 25, two rods 51 (FIG. 5) disposed in the opening 29 and movable in opposite directions between respective first and second positions, and at least two weights 59 adapted be attached to respective ones of the two anchorages. The illustrated weight apparatus 21 is a dumbbell, however, the weight apparatus can be a barbell.

The weight apparatus 21 also typically comprises a stand 65. The stand 65 comprises a weight seat 67 for the weight 59 and a bar seat 69 for the bar 23. The bar 23 is ordinarily only receivable in the bar seat 69 in a single position in which the anchorage 27 is not rotatable relative to the stand yet the handle 25 is rotatable relative to the anchorage. The anchorage 27 is adapted to be received in the weight opening 61 of the weight 59 when the weight is received in the weight seat 67 and the bar 23 is received in the bar seat 69. Ordinarily, the rod 51 is axially movable in the opening 29 only when the bar 23 is received in the bar seat 69. U.S. patent application Ser. Nos. 12/744,965, 12/744,972, and 12/744,975, which are incorporated by reference, disclose weight apparatus including a stand for receiving a bar so that an anchorage is not rotatable relative to the stand while a handle is rotatable relative to the anchorage and rotation of the handle causes a rod in an opening in the bar to move axially relative to the opening.

The weight apparatus 21 typically comprises a second weight 71. The second weight 71 and the anchorage body 31 comprise a joint that permits radial movement and prevents axial movement of the second weight relative to the anchorage body. The joint can be in the form of a V-shaped dovetail connection. In the embodiments illustrated, the joint comprises a male V-shaped dovetail joint portion 73 on the anchorage body 31 and a female V-shaped dovetail joint portion 75 (a portion of which is seen in FIG. 1B) on the second weight 71. The second weight 71 is seated in the weight seat 67 with the female joint portion 75 facing upwardly and the bar 23 is lowered to the bar seat 69 so that the male joint portion 73 mates with the female joint portion.

The weight apparatus 21 typically comprises at least one and usually a plurality of third weights 77. The second weight 71 and the third weight 77 comprise a joint that can be of the same type as the joint between the anchorage body 31 and the second weight and that permits radial movement and prevents axial movement of the third weight relative to the second weight or another third weight. In other words, the third weight 77, which is ordinarily identical to and interchangeable with the second weight 71, ordinarily comprises, on one side of the disc, a male V-shaped dovetail joint portion and, on the other side of the disc, a female V-shaped dovetail joint portion.

The second weight 71 comprises a second weight axial opening 79 (shown in phantom in FIG. 4) and the third weight(s) comprises a third weight axial opening 81. When the rod 51 is axially moved into the second weight axial opening 79, the second weight 71 is prevented from moving radially relative to the bar 23 by the rod, and is prevented from moving axially relative to the bar by the joint between the anchorage housing 31 and the second weight. If the rod 51 is not axially moved into the third weight axial opening 81, the bar 23 and the second weight 71 can be radially moved relative to the third weight 77 and lifted from the stand 65. When the rod 51 is moved axially into the third weight(s) axial opening(s) 81, the second weight 71 and the third weight(s) are both prevented from axially moving relative to the anchorage body 31 by the dovetail joints between the anchorage body and the second weight and between the second weight and the third weight (and between any additional third weights that might be provided) and are prevented from moving radially relative to the bar 23 by the rod. In this configuration, the bar 23 can be lifted from the stand 65 together with the second weight 71 and as many additional third weights 77 as it might be desired to provide.

The weight apparatus 21 can be arranged so that, when the bar 23 is seated in the bar seat 69, initially, the rods 51 are in the position shown in FIGS. 2 and 3, with the first ends 35 of the pins 33 in contact with the narrow second portion 53 of the rods so the pins are disposed at their innermost positions. In this position, neither the weights 59 nor the second or third weights 71 or 77 are attached to the bar. Upon turning the handle 25 relative to the anchorage 27 so that the rods 51 move axially outward so that the first ends 35 of the pins 33 are in contact with the wider first portions 53 of the rods so that the pins are disposed in their outermost positions, the second ends 37 of the pins are received in the pin openings 63 of the weights 59 and, if the bar 23 is lifted from the stand 65, the weights 59 will lift out of the stand with the bar.

Upon further turning the handle 25 relative to the anchorage 27 so that the rods 51 move axially outward so that the first ends 35 of the pins 33 are in contact with the narrower second portion 55' of the rod, the second ends of the pins are withdrawn from the pin openings 63 of the weights, however, the rod is received in the axial opening 79 of the second weight 71 and, if the bar 23 is lifted from the stand 64, the second weight 71 will lift out of the stand with the bar. Upon further turning the handle 25 relative to the anchorage 27 so that the rods 51 move axially outward so that the first ends 35 of the pins 33 are in contact with the wider first portion 53' of the rods so that the pins are disposed in their outermost positions, the second ends 37 of the pins are again received in the pin openings 63 of the weights 59 and, if the bar 23 is lifted from the stand 65, the weights 59 and the second weights 71 will lift out of the stand with the bar.

Upon further turning the handle 25 relative to the anchorage 27 so that the rods 51 move axially outward so that the first ends 35 of the pins 33 are in contact with yet further narrower second portions of the rod, the second ends of the pins are withdrawn from the pin openings 63 of the weights, however, the rod is received in the axial opening(s) 81 of the third weight(s) 77 and, if the bar 23 is lifted from the stand 64, the second weight 71 and one or more third weights 77 will lift out of the stand with the bar. Upon further turning the handle 25 relative to the anchorage 27 so that the rods 51 move axially outward so that the first ends 35 of the pins 33 are in contact with yet further wider first portions of the rods so that the pins are disposed in their outermost positions, the second ends 37 of the pins are again received in the pin openings 63 of the weights 59 and, if the bar 23 is lifted from the stand 65, the weights 59, the second weights 71, and one or more third weights 77 will lift out of the stand with the bar.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A weight apparatus, comprising:

a bar assembly comprising a handle attached to an anchorage, the handle and the anchorage having an axially extending opening, a rod at least partially disposed in and axially movable relative to the axially extending opening, and means for moving the rod axially relative to the axially extending opening;

a first weight having a through hole and configured to be secured to the bar assembly upon movement of the rod axially into the through hole; and a second weight comprising a weight opening extending radially inward from an outer edge of the second weight such that the second weight is C-shaped when viewed in an axial direction of the weight apparatus and into and from which the anchorage is adapted to be moved radially.

2. The weight apparatus as set forth in claim 1, wherein the rod is non-rotatable relative to the anchorage.

3. The weight apparatus as set forth in claim 1, wherein the second weight is generally U-shaped.

4. The weight apparatus as set forth in claim 1, wherein the weight apparatus is a dumbbell.

5. The weight apparatus as set forth in claim 1, comprising at least one third weight, the at least one third weight and the anchorage comprising a joint that permits radial movement and prevents axial movement of the third weight relative to the anchorage.

6. The weight apparatus as set forth in claim 5, wherein the at least one third weight comprises an axial opening, and the rod is adapted to be axially moved into and removed from the axial opening, the at least one third weight being prevented from radially moving relative to the anchorage when the rod is disposed in the axial opening of the at least one third weight.

7. The weight apparatus as set forth in claim 5, wherein the joint is a dovetail joint.

8. The weight apparatus as set forth in claim 5, wherein the first weight and the at least one third weight are identical.

9. A weight apparatus, comprising:

a bar assembly comprising a handle attached to an anchorage, the handle and the anchorage having an axially extending opening, a rod at least partially disposed in and axially movable relative to the axially extending opening, and means for moving the rod axially relative to the axially extending opening;

a first weight having a through hole and configured to be secured to the bar assembly upon movement of the rod axially into the through hole; and a second weight comprising a weight opening extending radially inward from an outer edge of the second weight and into and from which the anchorage is adapted to be moved radially, wherein the anchorage comprises a body and a lock, the lock comprising at least one pin that is radially extendable and retractable relative to the body between an innermost position and an outermost position, an end of the pin extending radially beyond an external surface of the body when the pin is in the outermost position, the second weight comprising a radially extending pin opening adapted to receive the pin when the pin is in the outermost position to attach the second weight to the anchorage, and means for driving the pin to the outermost position.

10. The weight apparatus as set forth in claim 9, wherein the lock is arranged to lock the second weight to the anchorage when the rod is axially moved relative to the axially extending opening to any one of a plurality of locking positions, and to unlock the second weight from the anchorage when the rod is axially moved relative to the axially extending opening to any one of a plurality of unlocking positions.

11. The weight apparatus as set forth in claim 9, wherein the lock is arranged to lock the second weight to the anchorage when the rod is axially moved relative to the axially extending opening to any one of a plurality of locking positions, and to unlock the second weight from the anchorage when the rod is axially moved relative to the axially extending opening to any one of a plurality of unlocking positions, and wherein, in one of the locking positions and one of the unlocking positions, the second weight is prevented from radially moving relative to the anchorage.

12. The weight apparatus as set forth in claim 9, wherein the pin driving means comprises a cam.

* * * * *